US011155376B2

(12) United States Patent
Zhang et al.

(10) Patent No.: US 11,155,376 B2
(45) Date of Patent: Oct. 26, 2021

(54) CIGARETTE FILTER ROD BOXING MACHINE

(71) Applicant: Zhengzhou Haiyi Technology Co. ltd., Zhengzhou (CN)

(72) Inventors: Haiping Zhang, Zhengzhou (CN); Jianfang Wang, Zhengzhou (CN); Hui Liang, Zhengzhou (CN); Xudong Zeng, Zhengzhou (CN); Shuhua Zhao, Zhengzhou (CN); Juqing Liu, Zhengzhou (CN); Yizhen Chang, Zhengzhou (CN); Kexin Shui, Zhengzhou (CN)

(73) Assignee: ZHENGZHOU HAIYI TECHNOLOGY CO. LTD., Zhengzhou (CN)

( * ) Notice: Subject to any disclaimer, the term of this patent is extended or adjusted under 35 U.S.C. 154(b) by 74 days.

(21) Appl. No.: 16/731,453

(22) Filed: Dec. 31, 2019

(65) Prior Publication Data

US 2021/0086930 A1 Mar. 25, 2021

(30) Foreign Application Priority Data

Sep. 25, 2019 (CN) ..... 201910909964.0
Dec. 10, 2019 (CN) ..... 201911259522.2

(51) Int. Cl.
*B65B 19/12* (2006.01)
*A24C 5/354* (2006.01)
*B65B 19/10* (2006.01)

(52) U.S. Cl.
CPC ..... *B65B 19/12* (2013.01); *A24C 5/354* (2013.01); *B65B 19/10* (2013.01)

(58) Field of Classification Search
CPC ..... B65B 19/04; B65B 19/10; B65B 19/12; B65B 5/068; A24C 5/354
USPC ..... 53/147, 150, 148, 531, 540, 542
See application file for complete search history.

(56) References Cited

U.S. PATENT DOCUMENTS 3,448,846 A * 6/1969 Dietrich ..... B65B 19/10 198/418.3
4,827,691 A * 5/1989 Hanada ..... A24C 5/354 53/151
2001/0047806 A1* 12/2001 Spatafora ..... B65B 19/10 131/282
2016/0221698 A1* 8/2016 Warchol ..... B65B 35/42

* cited by examiner

*Primary Examiner* — Anna K Kinsaul
*Assistant Examiner* — Luis G Del Valle
(74) *Attorney, Agent, or Firm* — Bayramoglu Law Offices LLC

(57) ABSTRACT

A cigarette filter rod boxing machine, including a cigarette filter rod holding mechanism and a cigarette filter rod pushing mechanism. The cigarette filter rod holding mechanism includes a lifting groove and a lifting power mechanism. The cigarette filter rod pushing mechanism includes a bottom plate, a middle push plate, a middle push vertical plate, an upper push plate, and an upper push plate limiting mechanism. The middle push vertical plate is vertically fixed on one side of the middle push plate, and the other side of the middle push vertical plate is precisely opposite to the other side of the U-shaped groove body. The first power mechanism used for controlling the middle push plate and the components on the middle push plate to advance to or return from the inside of the lifting groove is arranged between the bottom plate and the middle push plate.

14 Claims, 9 Drawing Sheets

CIGARETTE FILTER ROD BOXING MACHINE

CROSS REFERENCE TO THE RELATED APPLICATIONS

This application is based upon and claims priority to Chinese Patent Application No. 201910909964.0, filed on Sep. 25, 2019, and No. 201911259522.2, filed on Dec. 10, 2019, the entire contents of which are incorporated herein by reference.

TECHNICAL FIELD

The present disclosure relates to the technical field of cigarette production, and more particularly to a cigarette filter rod boxing machine.

BACKGROUND

Presently, tobacco and cigarette machinery is becoming more advanced, increasing production rate and automation. As cigarette filter rod forming machine production rates increase, the boxing capacity of cigarette filter rods must also increase. The improvement of the boxing capacity of the cigarette filter rods has become the focus among various cigarette filter rod manufacturers.

Currently, cigarette filter rods are boxed by vertically dropping and pushing the cigarette filter rods into boxes in batches. The fastest boxing rate is less than 10,000 pieces/min. Moreover, the filter rods are likely to become hollow from the impact of the drop. Vertically dropping the cigarette filter rods is inconvenient for the production quality management because it causes an inaccurate count of the whole product tray, and makes it difficult to count product. Furthermore, this method of boxing is prone to affecting the alignment of different layers of cigarette filter rods.

In addition, most devices available on the market can push two or three layers of the cigarette filter rods at one time, and the frequency of the reciprocating movement of the cigarette filter rod pushing mechanism reaches 60 times/min or 40 times/min calculated based on the speed of 10,000 pieces/min. Such a high-frequency reciprocating movement requires increased strength, weight, and fatigue resistance of various components of the apparatus. However, it is difficult to provide an apparatus having those increased qualities also having a reasonable price.

At present, the filter rod forming machine with the production rate of 12000 pieces/min has emerged on the market, and therefore the existing boxing machines can no longer satisfy the increasing demands.

SUMMARY

In order to solve the technical problem mentioned above, the present disclosure provides a cigarette filter rod boxing machine, which reaches the required boxing speed of the cigarette filter rod, and maintains the quality of the packaged cigarette filter rod, thereby overcoming the drawbacks of the existing cigarette filter rod boxing method.

In order to solve the above-mentioned technical problem, the present disclosure provides a cigarette filter rod boxing machine including a cigarette filter rod holding mechanism and a cigarette filter rod pushing mechanism. The cigarette filter rod holding mechanism includes a cigarette filter rod lifting groove and a lifting power mechanism used for driving the cigarette filter rod lifting groove to move up and down. The cigarette filter rod lifting groove includes a U-shaped groove body enclosed by a lifting horizontal plate and two vertical plates. One side of the U-shaped groove body of the cigarette filter rod lifting groove is opposite to the opening of the cigarette filter rod box body. The cigarette filter rod pushing mechanism includes a bottom plate, a middle push plate, a middle push vertical plate, an upper push plate, and an upper push plate limiting mechanism. The middle push vertical plate is vertically fixed on one side of the middle push plate, the other side of the middle push vertical plate is opposite to the other side of the U-shaped groove body of the cigarette filter rod lifting groove. The lower surface of the upper push plate is attached to the top surface of the middle push vertical plate. A first linear guide rail mechanism and a first power mechanism are arranged between the bottom plate and the middle push plate. The first power mechanism is used for controlling the middle push plate and the components on the middle push plate to advance to or return from the inside of the cigarette filter rod lifting groove relative to the bottom plate. A second linear guide rail mechanism and a second power mechanism are arranged between the middle push plate and the upper push plate. The second power mechanism is used for controlling the upper push plate to move horizontally relative to the middle push plate. The upper push plate limiting mechanism is used for controlling the upper push plate to move with or not move with the middle push plate.

Further, the lifting power mechanism includes two electric cylinders respectively arranged on two sides of the lifting groove, a shaft coupling and a transmission shaft connected to the bottoms of the two electric cylinders, and a speed reducer and a servo motor connected to the speed reducer. The two sides of the lifting groove are fixedly connected to sliding blocks of the two electric cylinders, respectively. The speed reducer is connected to one of the two electric cylinders. The speed reducer drives the two electric cylinders to operate simultaneously under the action of the servo motor, thereby driving the lifting groove to ascend and descend.

Further the first power mechanism includes a servo motor and an electric cylinder. The servo motor is fixed on the lower side of the bottom plate, and the electric cylinder is fixed on the upper surface of the bottom plate. The servo motor is connected to the electric cylinder through a toothed belt, and drives the sliding block on the electric cylinder to move horizontally. The lower surface of the middle push plate is fixedly provided with a middle push plate connecting block, the middle push plate connecting block is connected to the sliding block of the electric cylinder, and the servo motor drives the middle push plate to move horizontally.

Further, the middle push plate connecting block is also fixedly connected to the sliding block in the first linear guide rail mechanism.

Further, the second power mechanism includes an air cylinder fixed on the upper surface of the middle push plate and an air cylinder connecting block fixed on the lower surface of the upper push plate. The air cylinder connecting block is connected to the extending end of the air cylinder, and the air cylinder drives the upper push plate to move horizontally relative to the middle push plate.

Further, the upper push plate limiting mechanism includes a limit pin and a third power mechanism used for controlling a movement of the limit pin. The upper push plate is provided with a limiting hole matched with the limit pin. The limit pin is engaged with or separated from the limiting hole under the action of the third power mechanism.

Further, the third power mechanism is an electromagnet with a telescopic rod. One end of the limit pin is fixedly connected to the extending end of the electromagnet, and the other end of the limit pin is matched with the limiting hole.

Further, the upper push plate limiting mechanism further includes a limit pin guide sleeve. The electromagnet shell and the limit pin guide sleeve are both fixed on the machine frame.

Further, the connecting part of the middle push plate and the middle push vertical plate is provided with a reinforcing plate. The two sides of the middle push plate are respectively provided with a middle push plate reinforcing strip.

Further, when the middle push plate and the upper push plate are not pushed out, the cigarette filter rod pushing surface of the upper push plate is aligned with the cigarette filter rod pushing surface of the middle push vertical plate. The height of the middle push vertical plate can be adjusted according to the height of the cigarette filter rods which are pushed out simultaneously.

Further, the cigarette filter rod boxing machine further includes an aligning mechanism, and the aligning mechanism includes a channel device used for conveying the cigarette filter rods and an aligning device arranged at the outlet of the channel device. The aligning device is located above the lifting groove of the cigarette filter rod holding mechanism. The aligning device includes a swing roller mounting plate, a plurality of shifting rods, a shifting rod fixing plate, a gear shaft, a rack, a driving device, and a guide rail. The swing roller mounting plate is fixed on the machine frame of the boxing machine. The plurality of shifting rods are spaced apart side by side in the horizontal direction, and one end of each shifting rod is installed on the shifting rod fixing plate through the gear shaft. The rack is arranged above the gear shaft and is meshed with the gear of the gear shaft, and the rack is fixedly connected to the swing roller mounting plate. The driving device is installed on the swing roller mounting plate, connected to the shifting rod fixing plate, and drives the shifting rod fixing plate to move left and right along a guide rail located below the shifting rod fixing plate. The guide rail is installed on the swing roller mounting plate.

Further, the driving device includes a motor, a crank, and a connecting spring piece. The motor is installed on the swing roller mounting plate, and is connected to one end of the shifting rod fixing plate successively through the crank and the connecting spring piece.

Further, the guide rail is a U-shaped guide rail, a group of rolling bearings are respectively arranged at the bottoms of both ends of the shifting rod fixing plate, and the group of rolling bearings includes rolling bearings rolling along the inner bottom of the U-shaped guide rail and rolling bearings respectively rolling along two inner side walls of the U-shaped guide rail.

Further, the rolling bearing is a rubber-coated rolling bearing, each group of rolling bearings includes four rubber-coated rolling bearings, where two rubber-coated rolling bearings are matched with the inner bottom of the U-shaped guide rail.

Further, one end of the shifting rod is connected to the gear shaft through a screw thread. The gear shaft is fixedly installed on the shifting rod fixing plate through a bearing.

Further, the cigarette filter rod boxing machine further includes a lifting mechanism, a box pushing mechanism, a full box pushing mechanism, and a discharge conveyor belt. On one side of the motion axis of the lifting mechanism, the aligning mechanism is arranged above the cigarette filter rod holding mechanism, and the full box pushing mechanism is arranged below the cigarette filter rod pushing mechanism. On the other side of the motion axis of the lifting mechanism, the box pushing mechanism is arranged above the discharge conveyor belt. The lifting mechanism is used for receiving the cigarette filter rod box body pushed by the box pushing mechanism and successively conveying the cigarette filter rod box body from top to bottom to the filter rod pushing position of the cigarette filter rod pushing mechanism and the full box pushing position of the full box pushing mechanism. The discharge conveyor belt receives and conveys the box body filled with filter rods which is pushed out by the full box pushing mechanism.

The present disclosure has the following advantages due to the above-mentioned setup.

1. The cigarette filter rod boxing machine of the present disclosure is provided with the cigarette filter rod holding mechanism and the cigarette filter rod pushing mechanism which are cooperated with each other, and thus the cigarette filter rod is handily and reasonably received and pushed out, thereby achieving the periodical filling action of the cigarette filter rods from two layers to the whole box or the whole tray. The cigarette filter rod boxing machine is flexible, highly efficient and practical, which matches the continuously increasing speed of the filter rod forming machine.

2. The cigarette filter rod pushing mechanism can achieve a synchronous movement of the middle push vertical plate and the upper push plate by the setup of the bottom plate, the middle push plate, the middle push vertical plate, the upper push plate and the upper push plate limiting mechanism, and can also realize an asynchronous movement of the middle push vertical plate and the upper push plate. Combined with the lifting movement of the cigarette filter rod holding mechanism, the cigarette filter rod is easily received and pushed out, which is scientific and reasonable, and is well designed. The middle push vertical plate with the desired height can be replaced to push the desired layers of the cigarette filter rods. Alternatively, the entire box or the entire tray of the cigarette filter rods can be pushed into the box body at one time, which greatly enhances the boxing efficiency.

3. The cigarette filter rod pushing mechanism also employs the electromagnet with a telescopic rod as the power mechanism, allowing the limit pin to extend out or retract by power on/off, thereby controlling the location of the upper push plate. The structure is simply and handily controlled.

4. In the aligning device, the driving device is used to allow the shifting rod fixing plate and the connecting members thereof to move left and right along the guide rail, the gear of the gear shaft on the shifting rod fixing plate is meshed with the rack, so as to drive the shifting rod connected to the gear shaft to rotate positively and reversely and move left and right horizontally, and to assist the cigarette filter rods fallen from the channel device in smoothly dropping down from the space of the shifting rod, which prevents defects from occurring due to the cigarette filter rods which are rubbed with one another, and ensures the alignment of the fallen cigarette filter rods, and thus ensures the boxing quality.

5. The overall structure of the aligning device is uncomplicated, only the shifting rod fixing plate and the connecting members thereof move left and right driven by the driving device, the moving part is light in weight, and thus improving the service life 6. During the left and right movement of the shifting rod fixing plate in the aligning device, the upper part is limited by the rack, while the bottom part, and the left and right sides are respectively limited by the guide rail and the rolling bearing matched with the guide rail. The whole movement is stable, the service life is greatly improved, and the rolling bearing has a longer service life compared to the linear bearing.

7. The cigarette filter rod boxing machine of the present disclosure greatly improves the boxing efficiency of the cigarette filter rods by the box pushing mechanism, the lifting mechanism, the aligning mechanism, the cigarette filter rod holding mechanism, the cigarette filter rod pushing mechanism, the full box pushing mechanism, and the discharge conveyor belt which are cooperated with one another, thereby achieving the scale production of the cigarette filter rod.

BRIEF DESCRIPTION OF THE DRAWINGS

The above-mentioned description is only the summary of the technical solution of the present disclosure, and the present disclosure will be further illustrated hereinafter with reference to the drawings and the embodiments in order to expressly understand the technical means of the present disclosure.

DETAILED DESCRIPTION OF THE EMBODIMENTS

Figure 1:
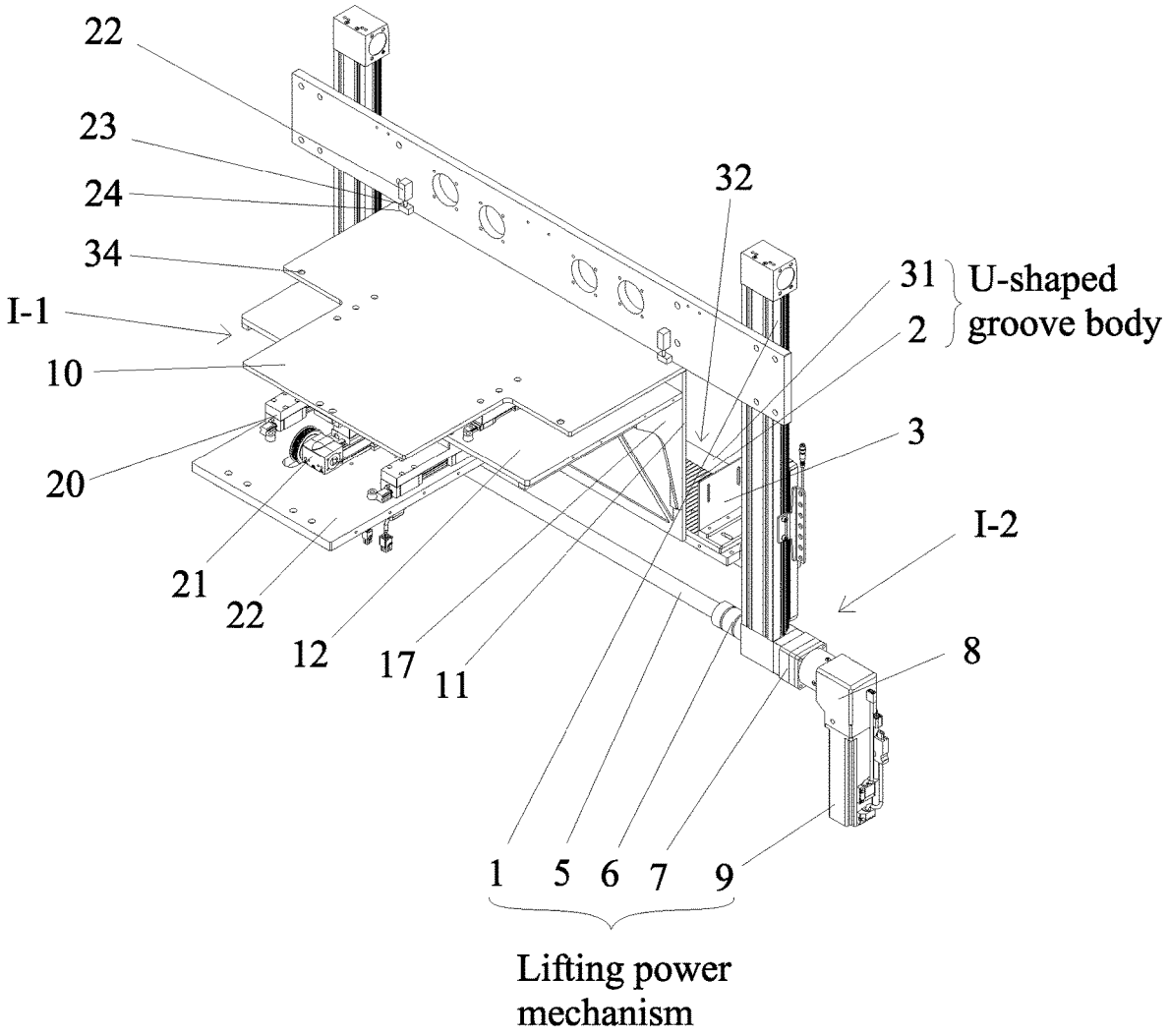
FIG. 1 is a schematic view showing the cigarette filter rod holding mechanism and the cigarette filter rod pushing mechanism of the cigarette filter rod boxing machine in one embodiment of the present disclosure.
Figure 2:
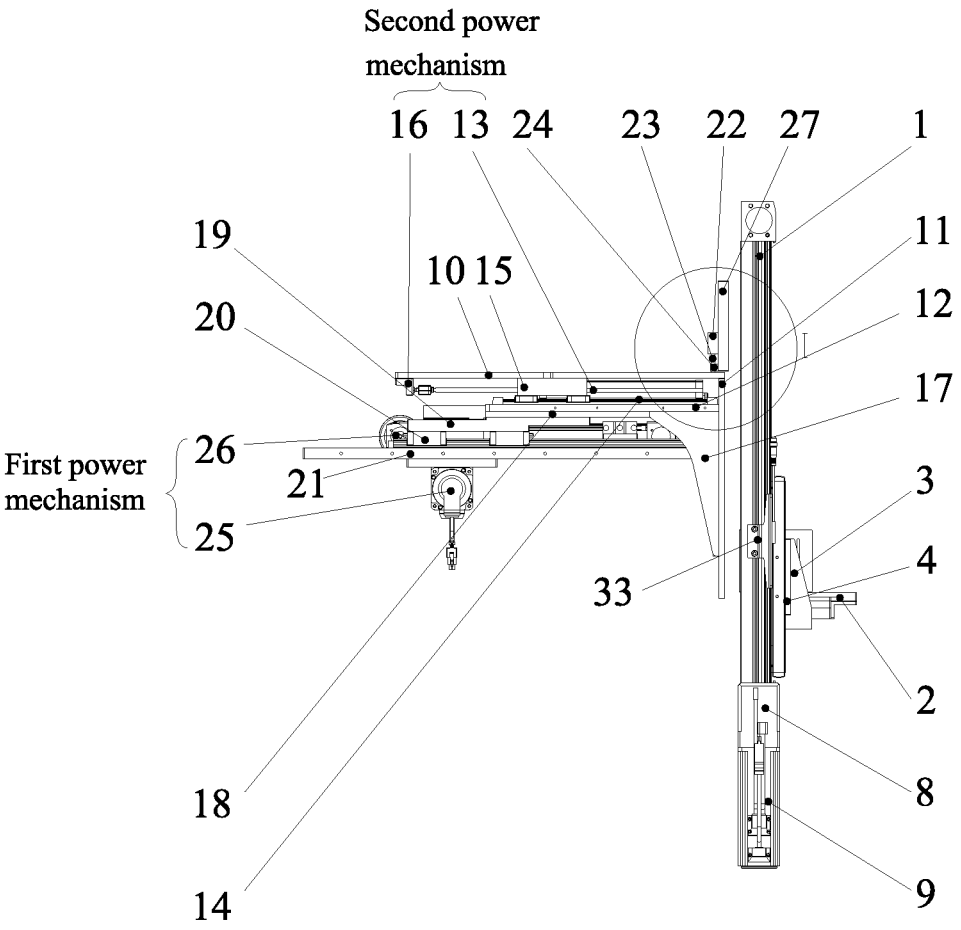
FIG. 2 is a side view showing the cigarette filter rod holding mechanism and the cigarette filter rod pushing mechanism of the cigarette filter rod boxing machine in one embodiment of the present disclosure.
Figure 3:
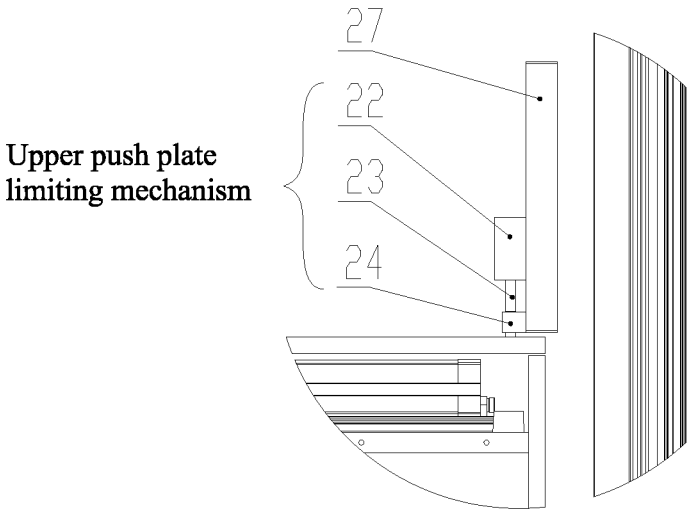
FIG. 3 is a partial enlarged view of FIG. 2.
Figure 4:
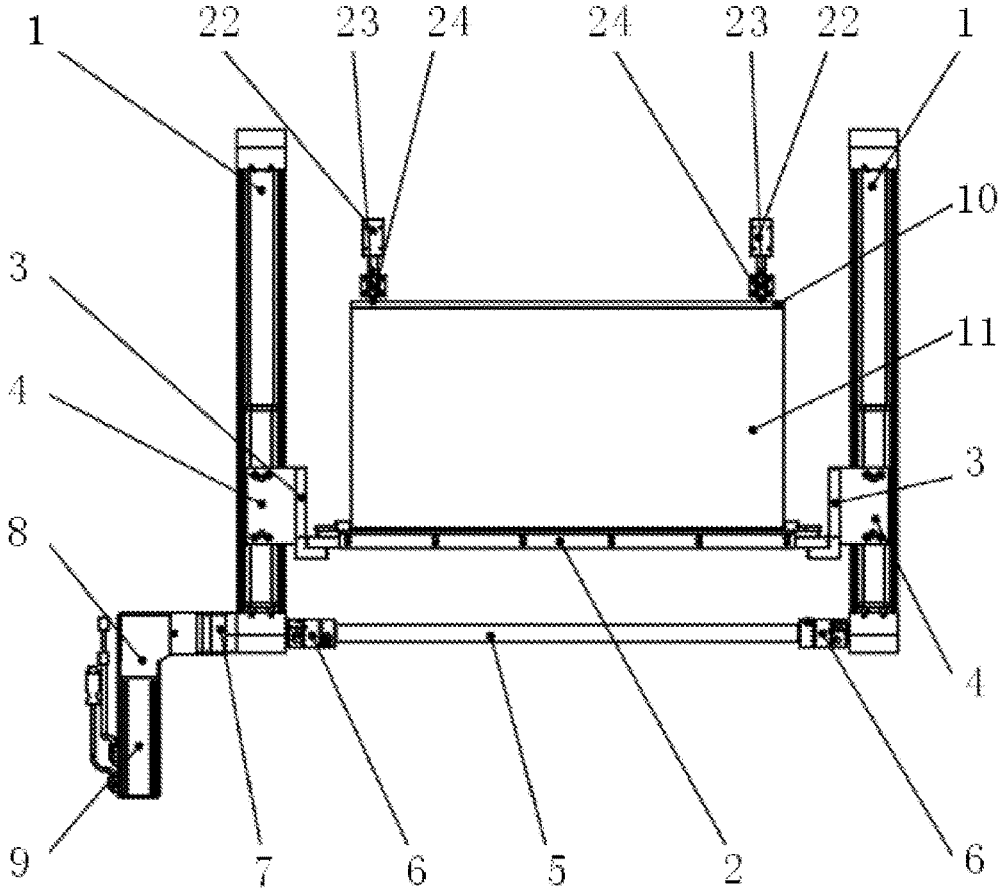
FIG. 4 is a front view showing the cigarette filter rod holding mechanism and the cigarette filter rod pushing mechanism of the cigarette filter rod boxing machine in one embodiment of the present disclosure.

As shown in FIGS. 1-4, the cigarette filter rod boxing machine of the present embodiment includes the cigarette filter rod holding mechanism I-1 and the cigarette filter rod pushing mechanism I-2.

The cigarette filter rod holding mechanism includes the cigarette filter rod lifting groove 32 and the lifting power mechanism which drives the lifting groove to move up and down.

In the present embodiment, the lifting groove includes a U-shaped groove body which is enclosed by the lifting horizontal plate 2 and the two vertical plates 31. The U-shaped groove body is used for orderly carrying the cigarette filter rods 28 which are well ordered. One side of the U-shaped groove body of the lifting groove is opposite to the opening of the cigarette filter rod box body 29, so that the cigarette filter rod pushing mechanism can smoothly push the cigarette filter rod 28 into the cigarette filter rod box body 29. The lifting power mechanism includes two electric cylinders 1 respectively arranged on both sides of the lifting groove, the shaft coupling 6 and the transmission shaft 5 connected to the bottoms of the two electric cylinders 1, the speed reducer 8, and the servo motor 9 connected to the speed reducer 8. The two sides of the lifting groove are fixedly connected to the sliding blocks 33 of the two electric cylinders 1 through the fixing plate 3 and the connecting block 4, respectively. The speed reducer 8 is connected to one of the two electric cylinders 1 by the mounting flange 7. The speed reducer 8 drives the two electric cylinders 1 to start simultaneously under the action of the servo motor 9, and thus drives the lifting groove to move up and down. The rotational speed of the servo motor 9 can be controlled according to the falling velocity of the cigarette filter rod 28.

The cigarette filter rod pushing mechanism includes the bottom plate 21, the middle push plate 12, the middle push vertical plate 11, the upper push plate 10, and the upper push plate limiting mechanism. The bottom plate 21 is fixed on the machine frame of the boxing machine and is immovable. The middle push vertical plate 11 is vertically fixed on one side of the middle push plate 12, and the other side of the middle push vertical plate 11 is opposite to the other side of the U-shaped groove body of the lifting groove. In addition, the first linear guide rail mechanism 20 and the first power mechanism are arranged between the bottom plate 21 and the middle push plate 12. The first power mechanism is used for controlling the middle push plate 12 and other components on the middle push plate 12 to advance to or return from the inside of the lifting groove relative to the bottom plate 21.

Specifically, the first power mechanism includes the servo motor 25 and the electric cylinder 26. The servo motor 25 is fixed on the lower side of the bottom plate 21, and the electric cylinder 26 is fixed on the upper surface of the bottom plate 21. A through hole is arranged on the bottom plate 21. The servo motor 25 is connected to the electric cylinder 26 through a toothed belt, and drives the sliding block 33 on the electric cylinder 26 to move horizontally. The lower surface of the middle push plate 12 is fixed to the middle push plate connecting block 19. The middle push plate connecting block 19 is connected to the sliding block 33 of the electric cylinder 26. The servo motor 25 drives the sliding block 33 on the electric cylinder 26 to move, and the middle push plate connecting block 19 is fixedly connected to the sliding block 33 of the electric cylinder 12 and the middle push plate 12, so that the horizontal movement of the middle push plate 12 and other components on the middle push plate 12 is controlled by the servo motor 25. Namely, the middle push plate 12, the middle push vertical plate 11, and the upper push plate 10 are controlled to move simultaneously.

The middle push plate connecting block 19 is also fixedly connected to the sliding block in the first linear guide rail mechanism 20. The first linear guide rail mechanism 20 allows the middle push plate 12 to move horizontally in a straight line and ensures a smooth movement of the middle push plate 12.

In order to enhance the strength of the middle push plate, the reinforcing plate 17 is arranged at the connecting part of the middle push plate 12 and the middle push vertical plate 11. The two sides of the middle push plate 12 are provided with the middle push plate reinforcing strip 18.

Further, when the middle push plate 12 and the upper push plate 10 are not pushed out, the cigarette filter rod pushing surface of the upper push plate 10 is aligned with the cigarette filter rod pushing surface of the middle push vertical plate 11, so that the cigarette filter rods 28 in the lifting groove are simultaneously pushed out. The lower surface of the upper push plate 10 abuts against the top surface of the middle push vertical plate 11, which prevents the cigarette filter rod from being omitted and ensures the boxing quality when the middle push vertical plate 11 and the upper push plate 10 are pushed out simultaneously. Namely, the vertical combined height of the pushing surface of the upper push plate 10 and the pushing surface of the middle push vertical plate 11 determines the height of the cigarette filter rods 28 which are pushed out. In an actual production, the middle push vertical plate 11 with the desired height can be replaced, so that two layers of the cigarette filter rods to a full box or a full tray can be pushed out.

In the present embodiment, the second linear guide rail mechanism 14 and the second power mechanism are arranged between the middle push plate 12 and the upper push plate 10. The second power mechanism is used for controlling the upper push plate 10 to move horizontally relative to the middle push plate 12.

The second power mechanism includes the air cylinder 13 fixed on the upper surface of the middle push plate 12 and the air cylinder connecting block 16 fixed on the lower surface of the upper push plate 10. The air cylinder connecting block 16 is connected to the extending end of the air cylinder 13, i.e., the air cylinder 13 can drive the upper push plate 10 to move horizontally relative to the middle push plate 12.

The lower surface of the upper push plate 10 is also connected to the upper push plate fixing block 15, and the upper push plate fixing block 15 is fixedly connected to the sliding block of the second linear guide rail mechanism 14. The second linear guide rail mechanism 14 allows the upper push plate to move horizontally in a straight line and ensures a smooth movement of the upper push plate 10.

The upper push plate limiting mechanism is used to control the upper push plate 10 to move with or not to move with the middle push plate 12. Namely, when the upper push plate 10 is limited by the upper push plate limiting mechanism, the upper push plate 10 does not move with the middle push plate 12; when the upper push plate limiting mechanism releases the limit, the upper push plate 10 can move with the middle push plate 12.

Specifically, the upper push plate limiting mechanism includes the limit pin 23, the limit pin guide sleeve 24, and the third power mechanism used for controlling the movement of the limit pin. The upper push plate 10 is provided with the limiting hole 34 matched with the limit pin 23, and the limit pin 23 is engaged with or disengaged with the limiting hole 34 under the action of the third power mechanism.

In the present embodiment, the third power mechanism is the electromagnet 22 with a telescopic rod. The shell of the electromagnet 22 and the limit pin guide sleeve 24 are both fixed on the machine frame 27 of the boxing machine or the traying machine. One end of the limit pin 23 is fixedly connected to the extending end of the electromagnet 22, and the other end of the limit pin 23 is engaged with the limiting hole 34 after passing through the limit pin guide sleeve 24.

The cigarette filter rod boxing machine of the present disclosure realizes the boxing operation of the cigarette filter rod 28 by the cigarette filter rod holding mechanism and the cigarette filter rod pushing mechanism which are cooperated with each other, and the working process thereof is specifically as follows.

Figure 5:
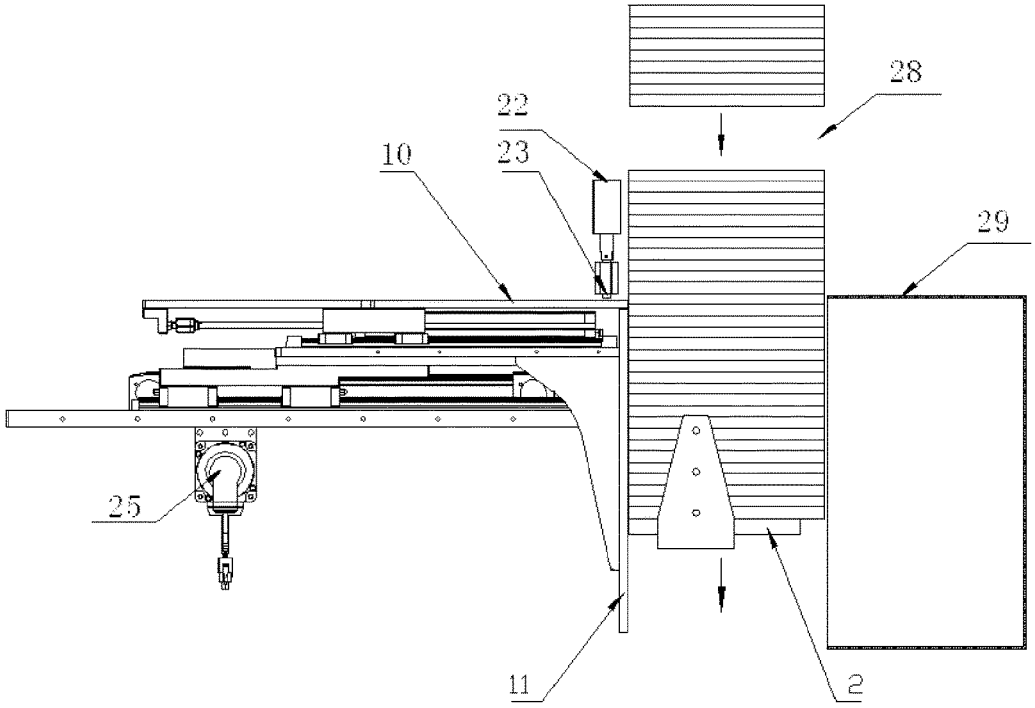
FIG. 5 is a schematic view of a first operating state (showing the lifting groove is dropping down) of the cigarette filter rod boxing machine in one embodiment of the present disclosure.
Figure 6:
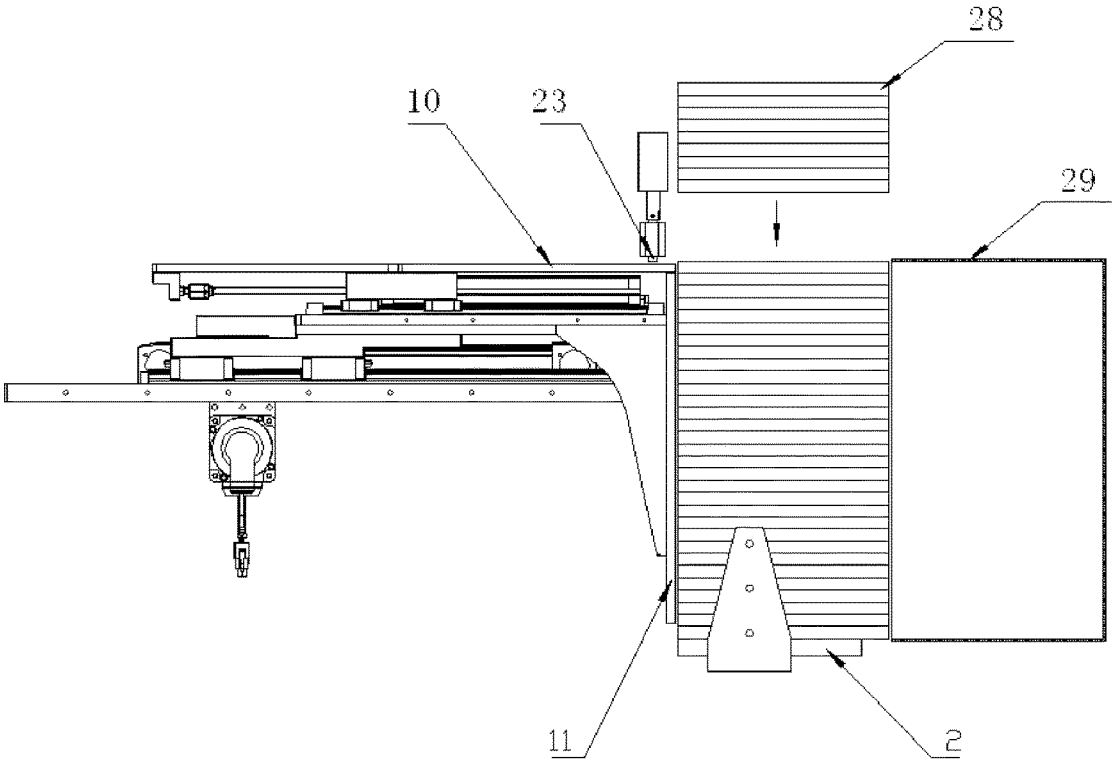
FIG. 6 is a schematic view of a second operating state (showing the lifting groove is dropping to a preset position) of the cigarette filter rod boxing machine in one embodiment of the present disclosure.
Figure 7:
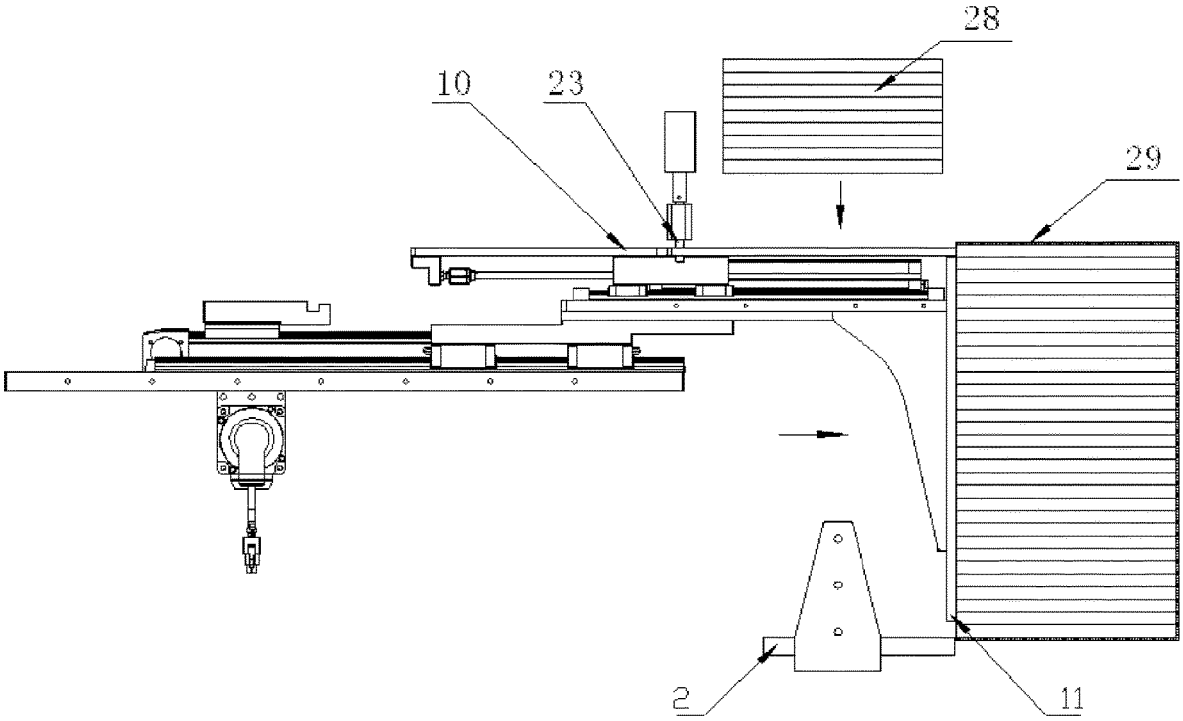
FIG. 7 is a schematic view of a third operating state (showing the cigarette filter rod is pushed into the box body by the middle push plate and the upper push plate) of the cigarette filter rod machine in one embodiment of the present disclosure.
Figure 8:
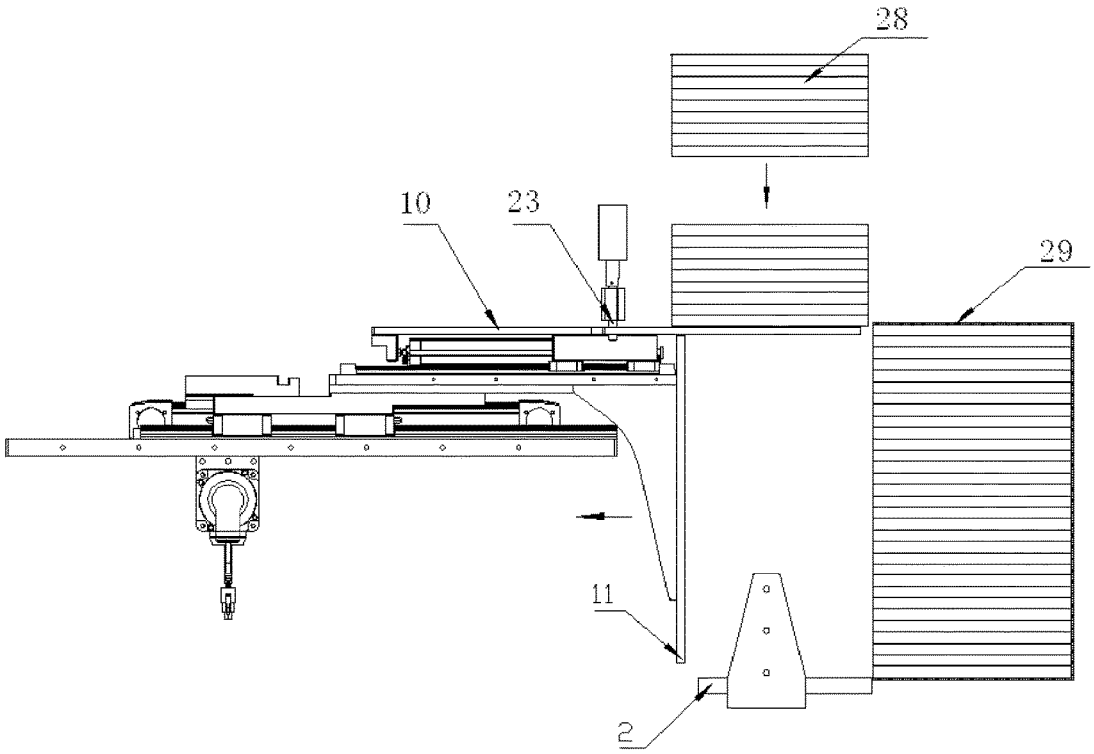
FIG. 8 is a schematic view of a fourth operating state (showing the upper push plate is limited and the middle push plate is returned) of the cigarette filter rod boxing machine in one embodiment of the present disclosure.
Figure 9:
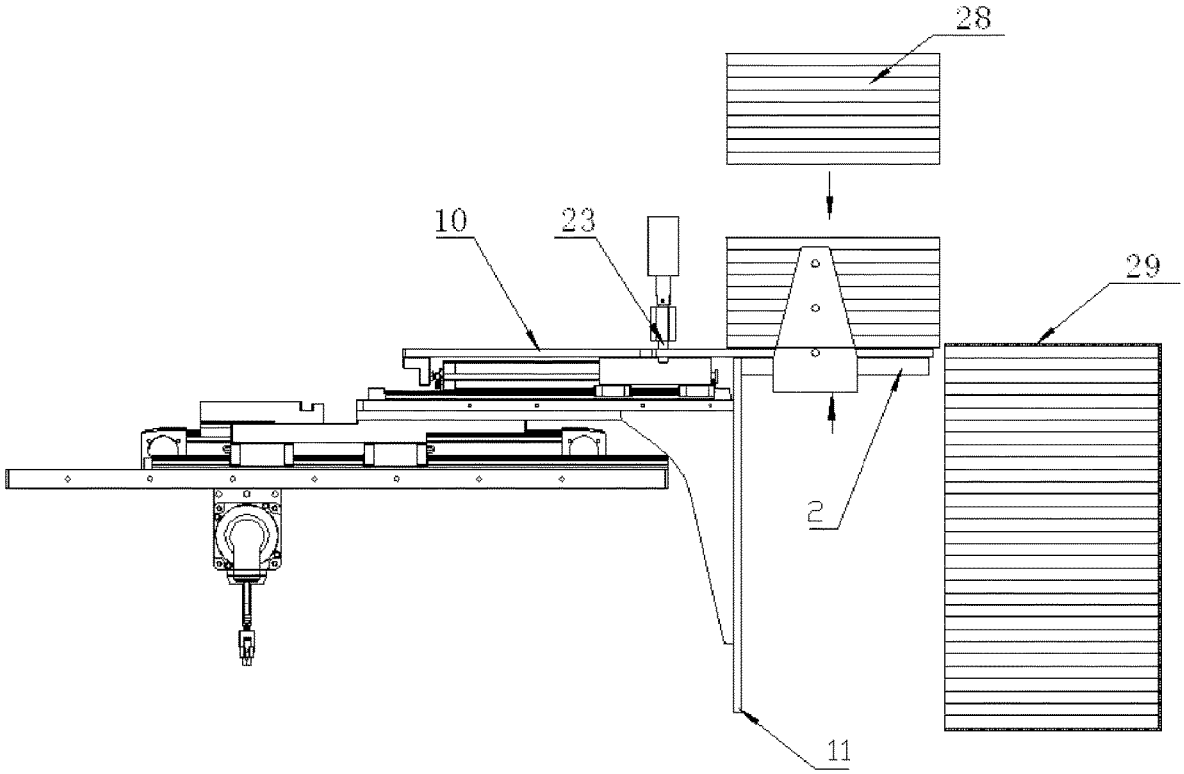
FIG. 9 is a schematic view of a fifth operating state (showing the upper push plate receives the cigarette filter rod and the lifting groove lifts) of the cigarette filter rod boxing machine in one embodiment of the present disclosure.
Figure 10:
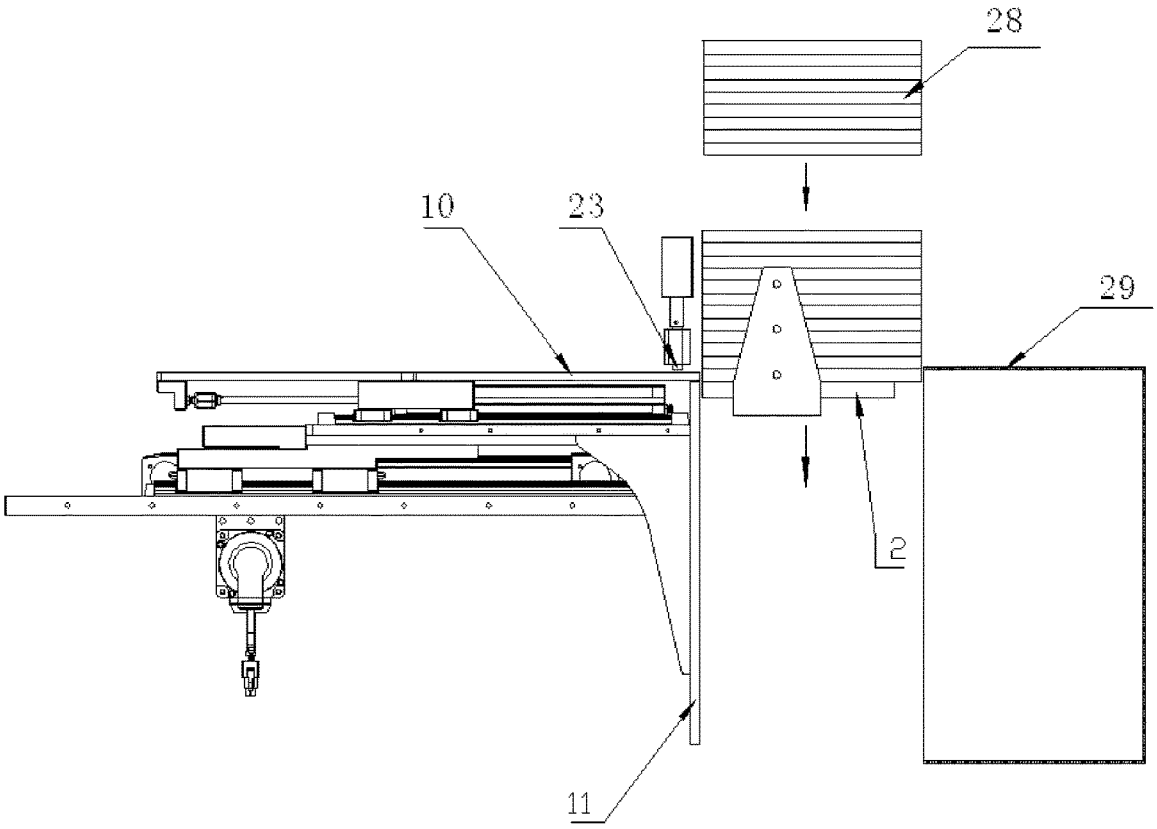
FIG. 10 is a schematic view of a sixth operating state (showing the upper push plate is not limited, the upper push plate is returned, the lifting groove receives the cigarette filter rods and then starts to descend) of the cigarette filter rod boxing machine in one embodiment of the present disclosure.

According to FIG. 5, the lifting groove receives the ordered cigarette filter rods 28 and moves downward at the same time, driven by the servo motor 9, until falling to the height of the cigarette filter rod set by the lifting groove or the height for filling the full box/tray, as the operating state shown in FIG. 6. At this time, the servo motor 25 is actuated to drive the middle push plate 12 and the upper push plate 10 to move horizontally to the lifting groove. Namely, the pushing surface of the middle push vertical plate 11 and the pushing surface of the upper push plate 10 drive the cigarette filter rods 28 in the lifting groove to move to the cigarette filter rod box body 29, thereby boxing the cigarette filter rods to the full box at one time, as shown in FIG. 7. According to FIG. 8, when the cigarette filter rods 28 are pushed into the box body 29 completely, the electromagnet 22 is conductive, the limit pin 23 extends out to be engaged with the limiting hole 34, and the upper push plate 10 is limited. At this time, the servo motor 25 is actuated to drive the middle push plate 12 and the middle push vertical plate 11 to return back. The upper push plate 10 does not move, so as to receive the ordered cigarette filter rods 28 dropping continuously. When the return distance of the middle push plate 12 and the middle push vertical plate 11 is larger than the width of the lifting groove, the lifting groove is lifted to the lower edge of the upper push plate 10 under the action of the servo motor 9, as shown in FIG. 9. At this time, the electromagnet 22 is powered off, the limit pin 23 retracts, the limit to the upper push plate 10 is removed, the air cylinder 13 is started and drives the upper push plate 10 to return, the lifting groove continues to receive the ordered cigarette filter rods 28 dropping continuously, and then the servo motor 9 starts to drive the lifting groove to drop down, as shown in FIG. 10, the next working cycle continues.

The cigarette filter rod holding mechanism contributes to the boxing of the cigarette filter rods periodically by controlling the ascend and descent of the lifting groove. The lifting speed of the lifting groove can be adjusted instantly according to the arrangement condition of the cigarette filter rods, which is flexible and handily used.

The cigarette filter rod pushing mechanism can replace the middle push vertical plate with desired height according to different demands to push out the desired layers of the cigarette filter rods. Alternatively, the cigarette filter rods are pushed into the whole cigarette filter rod box body at one time, which greatly improves the boxing efficiency. In addition, the middle push plate and the upper push plate can move synchronously or respectively move in two directions according to the requirements of different time points, thereby easily achieving the carry and pushing movement of the cigarette filter rod. The structure is well designed, scientific and reasonable, and matches up the continuously improved speed of the filter rod forming machine.

Figure 11:
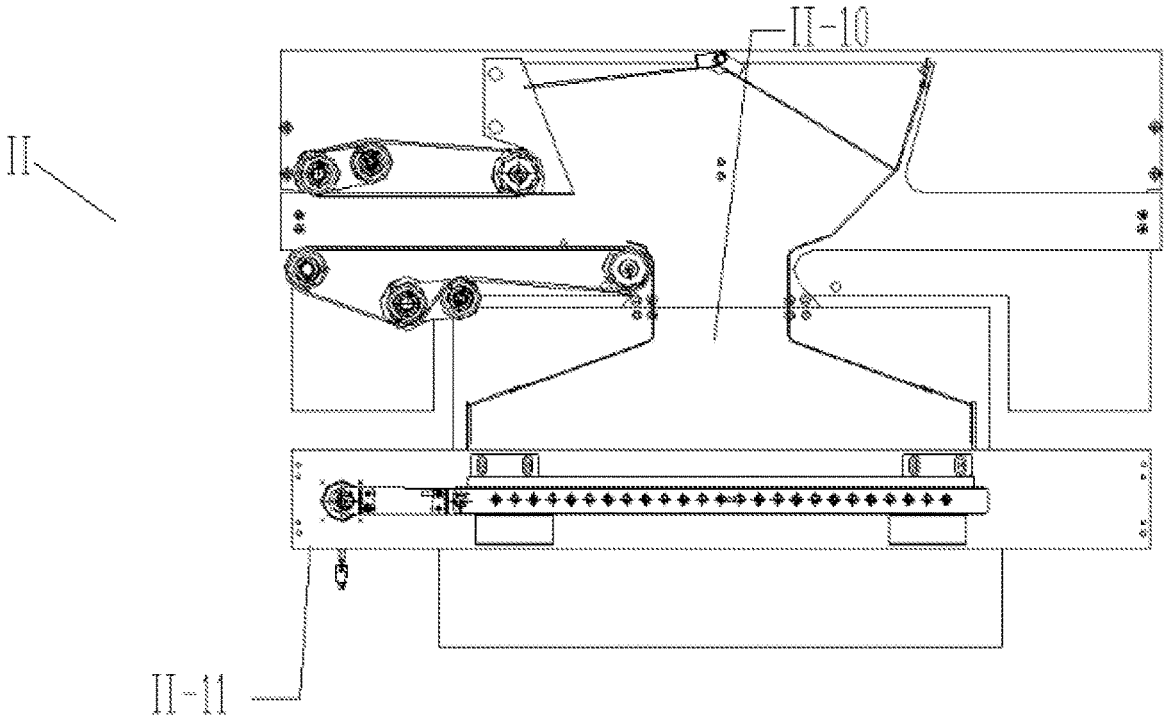
FIG. 11 is a schematic view showing the aligning mechanism of the cigarette filter rod boxing machine in one embodiment of the present disclosure.
Figure 12:
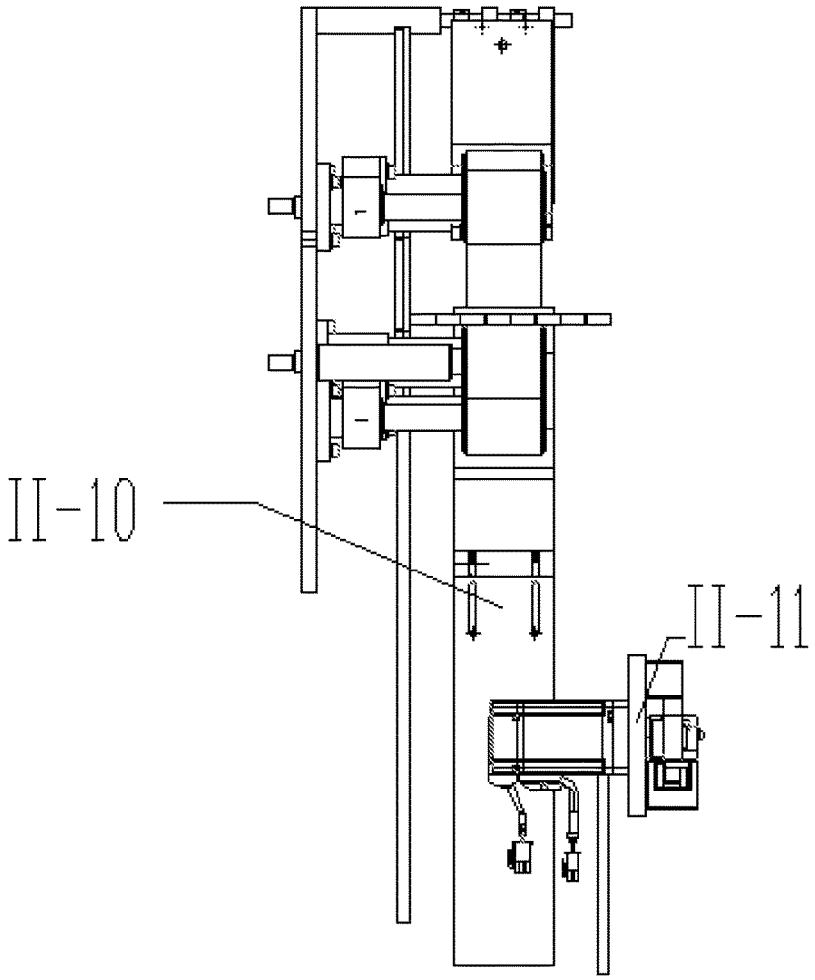
FIG. 12 is a side view of FIG. 11.

In the present embodiment, the cigarette filter rod boxing machine further includes the aligning mechanism II as shown in FIGS. 11 and 12. The aligning mechanism II is used for sorting the cigarette filter rods in order, and includes the channel device II-10 used for conveying the cigarette filter rods and the aligning device II-11 arranged at the outlet of the channel device II-10. The aligning device II-11 is located above the lifting groove of the cigarette filter rod holding mechanism.

Figure 13:
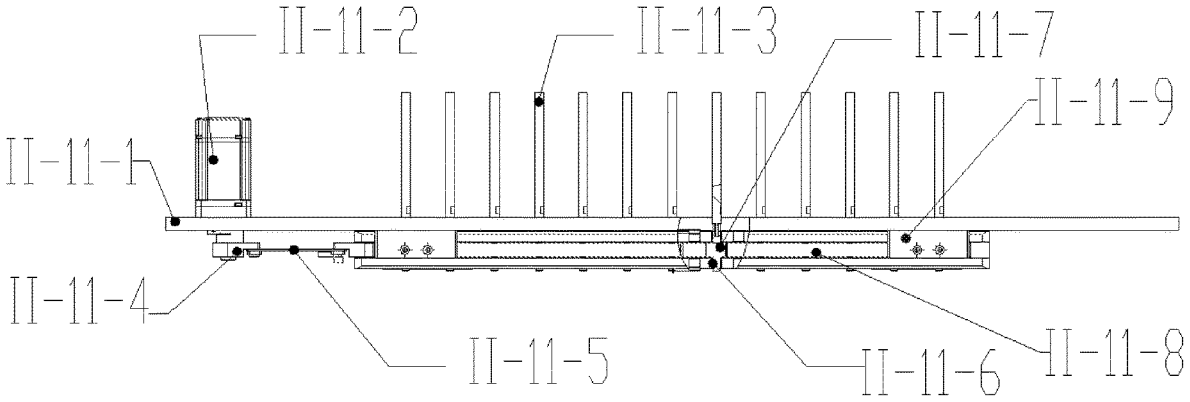
FIG. 13 is a top plan view showing the structure of the aligning device of FIG. 11.
Figure 14:
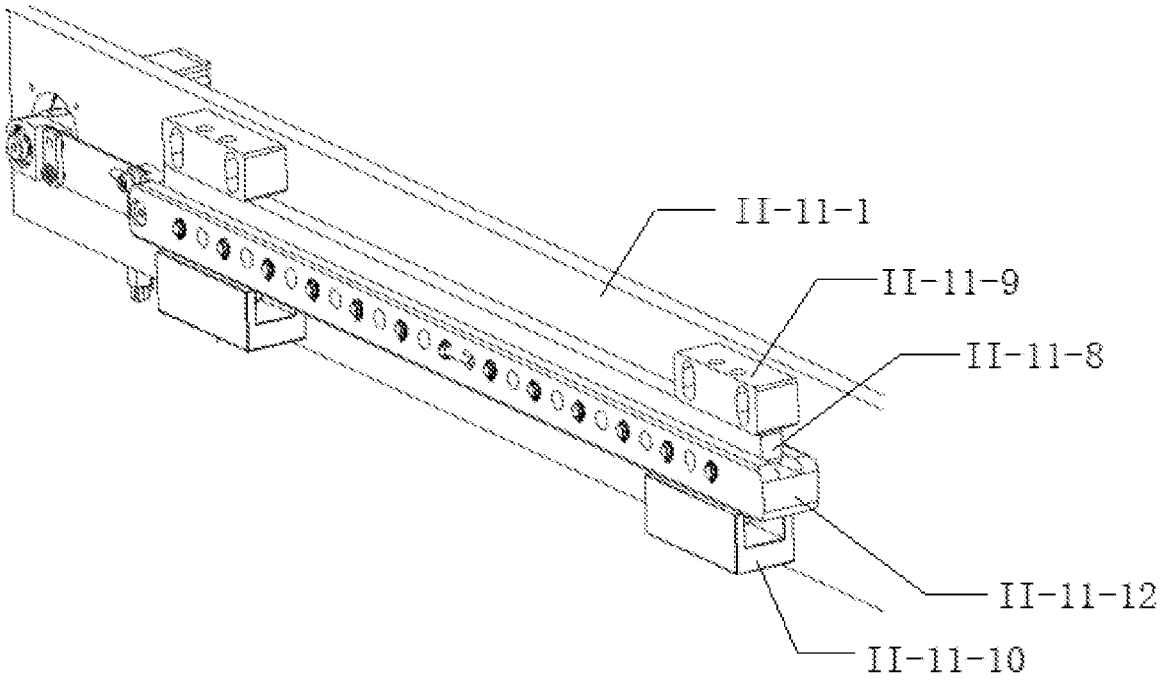
FIG. 14 is a perspective view showing a partial structure of the aligning device of FIG. 11.
Figure 15:
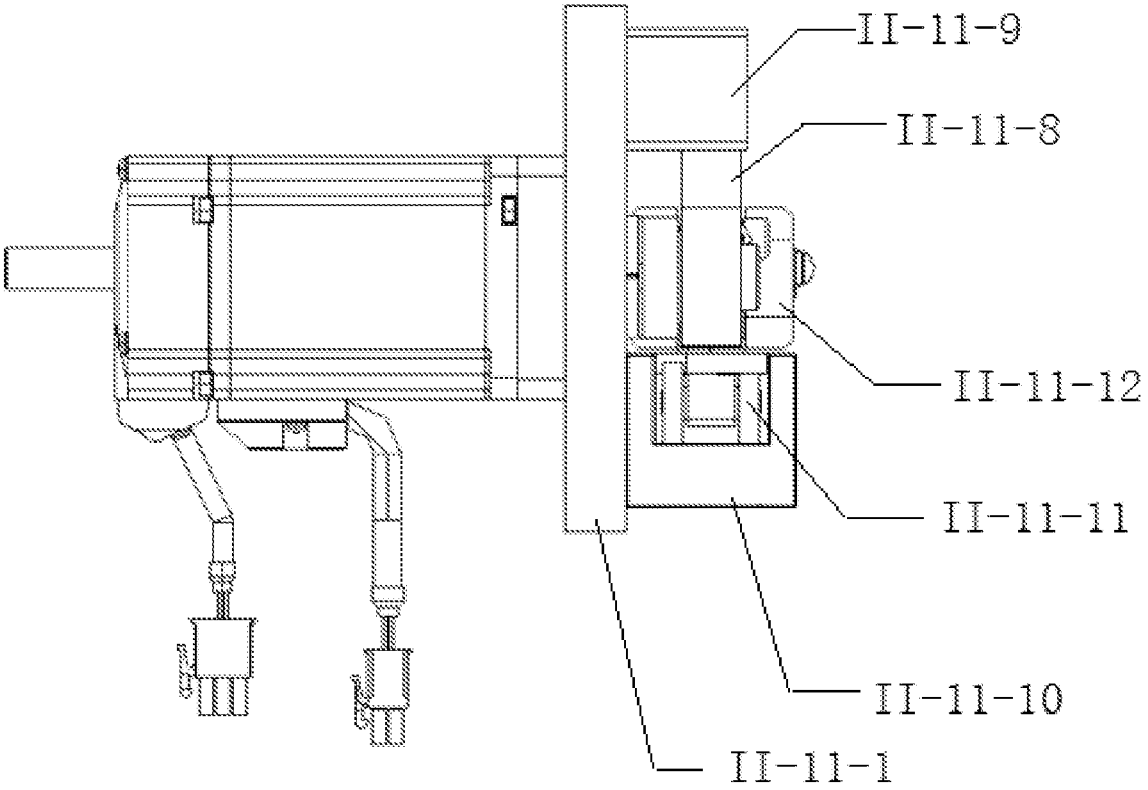
FIG. 15 is a side view showing the aligning device of FIG. 11.

According to the FIGS. 13-15, the aligning device II-11 includes the swing roller mounting plate II-11-1, the plurality of shifting rods II-11-3, the shifting rod fixing plate II-11-12, the gear shaft II-11-7, the rack II-11-8, the driving device, and the guide rail II-11-10. The swing roller mounting plate II-11-1 is fixed on the machine frame of the boxing machine. The plurality of shifting rods II-11-3 are spaced side by side along the horizontal direction. One end of each shifting rod II-11-3 is installed on the shifting rod fixing plate II-11-12 through the gear shaft II-11-7. One end of the shifting rod II-11-3 is connected to the gear shaft II-11-7 through a screw thread. The gear shaft II-11-7 is fixedly installed on the shifting rod fixing plate II-11-12 through the needle bearing II-11-6. The rack II-11-8 is arranged above the gear shaft II-11-7 and is meshed with the gear of the gear shaft II-11-7. The rack II-11-8 is fixedly connected to the swing roller mounting plate II-11-1 through the rack fixing block II-11-9. The driving device is arranged on the swing roller mounting plate II-11-1, is connected to the shifting rod fixing plate II-11-12, and drives the shifting rod fixing plate II-11-12 to move left and right along the guide rail II-11-10 located below the shifting rod fixing plate II-11-12. The guide rail II-11-10 is installed on the swing roller mounting plate II-11-1.

After starting up, the cigarette filter rod enters the channel device II-10, and then falls down to the aligning device II-11 to be sorted due to gravity. The driving device drives the shifting rod fixing plate II-11-12 and the connecting members thereof to move left and right along the guide rail II-11-10. The gear of the gear shaft II-11-7 on the shifting rod fixing plate II-11-10 is meshed with the rack II-11-8, drives the shifting rod II-11-3 connected to the gear shaft II-11-7 to rotate positively and reversely and move horizontally to the left and right, and can assist the cigarette filter rod fallen from the channel device II-10 in smoothly falling from the space of the shifting rod II-11-3, which avoids a disorder of the cigarette filter rods due to the cigarette filter rods which are rubbed with one another, and ensures the alignment of the fallen cigarette filter rods, and ensures the boxing quality. The overall structure of the aligning device II-11-1 is simple, only the shifting rod fixing plate and the connecting members thereof move to the left and right driven by the driving device, the moving part is light in weight and the service life is greatly improved.

The cigarette filter rods orderly fall down under the action of the shifting rod II-11-3 and are located layer by layer on the cigarette filter rod pushing mechanism i-2 and the cigarette filter rod holding mechanism I-1 arranged below the cigarette filter rods. Subsequently, the cigarette filter rod holding mechanism I-1 and the cigarette filter rod pushing mechanism i-2 start to operate, and the sorted cigarette filter rods are pushed into the cigarette filter rod box body 29.

In the present embodiment, the driving device includes the motor II-11-2, the crank II-11-4, and the connecting spring piece II-11-5. The motor II-11-2 is installed on the swing roller mounting plate II-11-1. The motor II-11-2 is connected to one end of the shifting rod fixing plate II-11-12 successively through the crank II-11-4 and the connecting spring piece II-11-5. The connecting spring piece II-11-5 can absorb the impact force generated when the shifting rod fixing plate II-11-12 and the connecting members thereof move left and right, which prevents the motor II-11-2 from overloading.

According to FIGS. 14-15, the guide rail II-11-10 of the present embodiment is a U-shaped guide rail. A group of rolling bearings II-11-11 is respectively arranged at the bottoms of two ends of the shifting rod fixing plate II-11-12, and the group of rolling bearings II-11-11 includes two rolling bearings rolling along the inner bottom of the U-shaped guide rail and a rolling bearing respectively rolling along the two inner side walls of the U-shaped guide rail. The rolling bearing is the rubber-coated rolling bearing, and the rolling bearing II-11-11 rolls in the U-shaped guide rail II-11-10 so as to reduce the resistance and noise. During the left and right movement of the shifting rod fixing plate II-11-12 in the aligning device, the upper part is limited by the rack II-11-8, while the bottom part, and the left and right sides are respectively limited by the guide rail II-11-10 and the rolling bearing II-11-11 matched with the guide rail, respectively. The whole movement is stable, the service life is greatly improved, and the rolling bearing has a longer service life compared with the linear bearing.

Figure 16:
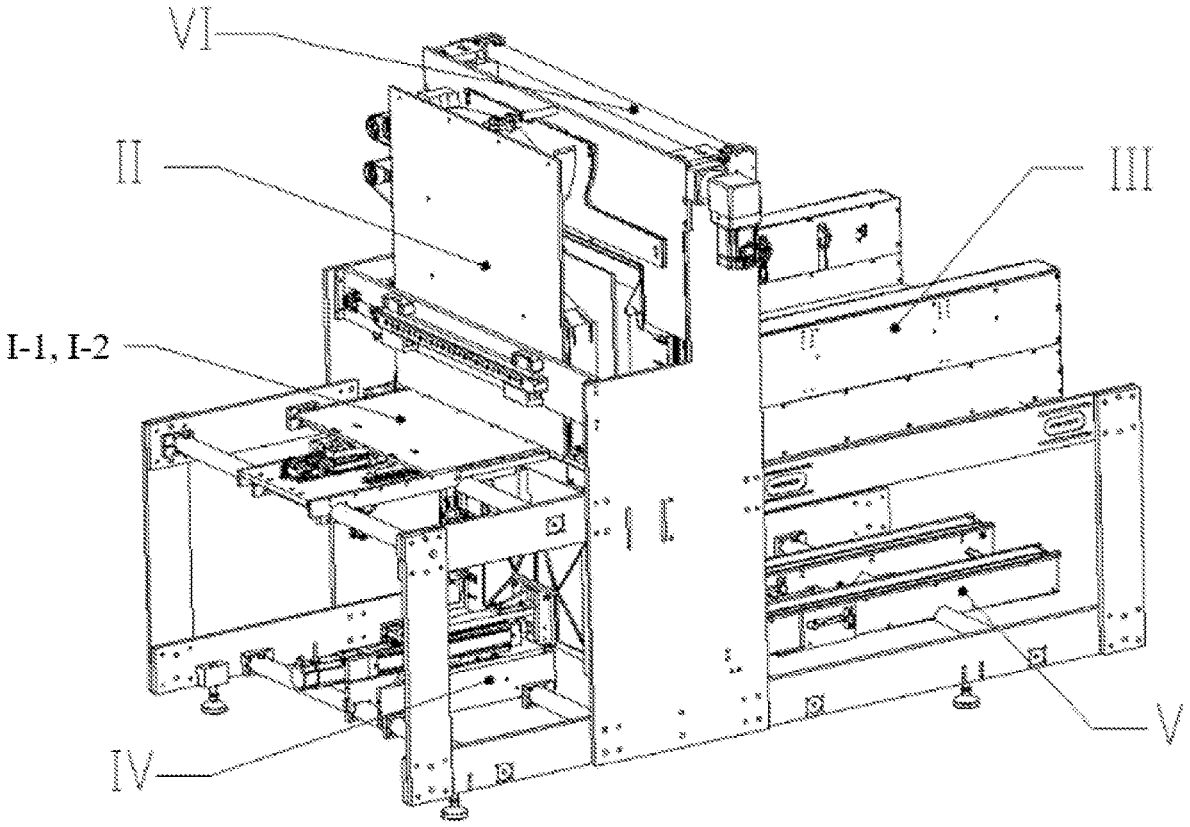
FIG. 16 is a structural schematic view showing the overall structure of the cigarette filter rod boxing machine in one embodiment of the present disclosure.

According to FIG. 16, the cigarette filter rod boxing machine of the present embodiment further includes the lifting mechanism VI, the box pushing mechanism III, the full box pushing mechanism IV, and the discharge conveyor belt V. On one side of the motion axis of the lifting mechanism VI, the aligning mechanism II is arranged above the cigarette filter rod holding mechanism, and the full box pushing mechanism IV is arranged below the cigarette filter rod pushing mechanism. On the other side of the motion axis of the lifting mechanism VI, the box pushing mechanism III is arranged above the discharge conveyor belt V.

When in operating, the box pushing mechanism III pushes the cigarette filter rod box body into the lifting mechanism VI, the lifting mechanism VI receives the cigarette filter rod box body pushed by the box pushing mechanism III and then drops to convey the cigarette filter rod box body to the filter rod pushing position of the cigarette filter rod pushing mechanism. The cigarette filter rod pushing mechanism pushes the cigarette filter rod into the cigarette filter rod box body, when the cigarette filter rod box body is filled up, the lifting mechanism VI continues to drop down, and the cigarette filter rod box body is conveyed to the full box pushing position of the full box pushing mechanism IV. The full box pushing mechanism IV pushes the box body filled with the filter rods to the discharge conveyor belt V, and the discharge conveyor belt V receives and conveys the box body filled with the filter rods.

The cigarette filter rod boxing machine of the present disclosure greatly improves the boxing efficiency of the cigarette filter rod by the box pushing mechanism III, the lifting mechanism VI, the aligning mechanism II, the cigarette filter rod holding mechanism I-1 and the cigarette filter rod pushing mechanism i-2, the full box pushing mechanism IV, and the discharge conveyor belt V which are cooperated with one another, thereby achieving the scale production of the cigarette filter rod.

The above-mentioned description is only a preferred embodiment of the present disclosure, which is not intended to limit the present disclosure in any form. All simple modifications, equivalent changes or improvements made by those skilled in the art using the technical content disclosed above would fall within the scope of protection of the present disclosure.

What is claimed is:

1. A cigarette filter rod boxing machine, comprising a cigarette filter rod holding mechanism and a cigarette filter rod pushing mechanism, wherein, the cigarette filter rod holding mechanism comprises a cigarette filter rod lifting groove and a lifting power mechanism configured to drive the cigarette filter rod lifting groove to move up and down; the cigarette filter rod lifting groove comprises a U-shaped groove body, the U-shaped groove body is enclosed by a lifting horizontal plate and two vertical plates; the U-shaped groove body of the cigarette filter rod lifting groove is opposite to an opening of a cigarette filter rod box body; and the cigarette filter rod pushing mechanism comprises a bottom plate, a middle push plate, a middle push vertical plate, an upper push plate, and an upper push plate limiting mechanism; the middle push vertical plate is vertically fixed on the middle push plate, the middle push vertical plate is precisely opposite to the U-shaped groove body of the cigarette filter rod lifting groove; the upper push plate abuts against the middle push vertical plate; a first linear guide rail mechanism and a first power mechanism are arranged between the bottom plate and the middle push plate; the first power mechanism is configured to control the middle push plate and components on the middle push plate to advance to or return from an inside of the cigarette filter rod lifting groove relative to the bottom plate; a second linear guide rail mechanism and a second power mechanism are arranged between the middle push plate and the upper push plate; the second power mechanism is configured to control a horizontal movement of the upper push plate relative to the middle push plate; the upper push plate limiting mechanism is configured to control the upper push plate to move with or not move with the middle push plate.

2. The cigarette filter rod boxing machine according to claim 1, wherein, the lifting power mechanism comprises two electric cylinders respectively arranged on two sides of the cigarette filter rod lifting groove, a shaft coupling, a transmission shaft, a speed reducer and a servo motor connected to the speed reducer, the shaft coupling and the transmission shaft are connected to bottoms of the two electric cylinders; the two sides of the cigarette filter rod lifting groove are fixedly connected to sliding blocks of the two electric cylinders, respectively; the speed reducer is connected to one of the two electric cylinders; the speed reducer drives the two electric cylinders to operate simultaneously under an action of the servo motor, and drives the cigarette filter rod lifting groove to ascend and descend.

3. The cigarette filter rod boxing machine according to claim 1, wherein, the first power mechanism comprises a servo motor and an electric cylinder; the servo motor is fixed on a lower side of the bottom plate, and the electric cylinder is fixed on an upper surface of the bottom plate; the servo motor is connected to the electric cylinder through a toothed belt, and the servo motor drives a sliding block on the electric cylinder to move horizontally; a lower surface of the middle push plate is fixed to a middle push plate connecting block, the middle push plate connecting block is connected to the sliding block of the electric cylinder, and the servo motor drives the middle push plate to move horizontally; the middle push plate connecting block is fixedly connected to a sliding block in the first linear guide rail mechanism.

4. The cigarette filter rod boxing machine according to claim 1, wherein, the second power mechanism comprises an air cylinder and an air cylinder connecting block, the air cylinder is fixed on an upper surface of the middle push plate and the air cylinder connecting block is fixed on a lower surface of the upper push plate; the air cylinder connecting block is connected to an extending end of the air cylinder, and the air cylinder drives the upper push plate to move horizontally relative to the middle push plate.

5. The cigarette filter rod boxing machine according to claim 1, wherein, the upper push plate limiting mechanism comprises a limit pin and a third power mechanism configured to control a movement of the limit pin; the upper push plate is provided with a limiting hole matched with the limit pin; the limit pin is engaged with or disengaged with the limiting hole under an action of the third power mechanism.

6. The cigarette filter rod boxing machine according to claim 5, wherein, the third power mechanism is an electromagnet; the limit pin is fixedly connected to an extending end of the electromagnet, and the limit pin is matched with the limiting hole.

7. The cigarette filter rod boxing machine according to claim 6, wherein, the upper push plate limiting mechanism further comprises a limit pin guide sleeve; a shell of the electromagnet and the limit pin guide sleeve are both fixed on a machine frame.

8. The cigarette filter rod boxing machine according to claim 1, wherein, when the middle push plate and the upper push plate are not pushed out, the upper push plate is aligned with the middle push vertical plate; a height of the middle push vertical plate is adjusted according to a height of cigarette filter rods pushed out at one time.

9. The cigarette filter rod boxing machine according to claim 1, further comprising an aligning mechanism; wherein the aligning mechanism comprises a channel device and an aligning device, the channel device is configured to convey cigarette filter rods and the aligning device is arranged at an outlet of the channel device; the aligning device is located above the cigarette filter rod lifting groove of the cigarette filter rod holding mechanism;

the aligning device comprises a swing roller mounting plate, a plurality of shifting rods, a shifting rod fixing plate, a gear shaft, a rack, a driving device, and a guide rail; and the swing roller mounting plate is fixed on a machine frame of the cigarette filter rod boxing machine; the plurality of shifting rods are spaced apart side by side in a horizontal direction, and a first end of each shifting rod of the plurality of shifting rods is installed on the shifting rod fixing plate through the gear shaft; the rack is arranged above the gear shaft and is meshed with a gear of the gear shaft, and the rack is fixedly connected to the swing roller mounting plate; the driving device is installed on the swing roller mounting plate and connected to the shifting rod fixing plate, and the driving device drives the shifting rod fixing plate to move left and right along the guide rail, the guide rail is located below the shifting rod fixing plate, and the guide rail is installed on the swing roller mounting plate.

10. The cigarette filter rod boxing machine according to claim 9, wherein, the driving device comprises a motor, a crank, and a connecting spring piece; the motor is installed on the swing roller mounting plate, and the motor is connected to one end of the shifting rod fixing plate successively through the crank and the connecting spring piece.

11. The cigarette filter rod boxing machine according to claim 9, wherein, the guide rail is a U-shaped guide rail, a group of rolling bearings are respectively arranged at bottoms of both ends of the shifting rod fixing plate; the group of rolling bearings comprises first rolling bearings and second rolling bearings, the first rolling bearings roll along an inner bottom of the U-shaped guide rail and the second rolling bearings roll along two inner side walls of the U-shaped guide rail.

12. The cigarette filter rod boxing machine according to claim 11, wherein, each of the group of rolling bearings is a rubber-coated rolling bearing, a number of the first rolling bearings is two, and a number of the second rolling bearings is two.

13. The cigarette filter rod boxing machine according to claim 9, wherein, a second end of the each shifting rod is connected to the gear shaft; the gear shaft is fixedly installed on the shifting rod fixing plate.

14. The cigarette filter rod boxing machine according to claim 9, further comprising a lifting mechanism, a box pushing mechanism, a full box pushing mechanism, and a discharge conveyor belt; wherein on a first side of a motion axis of the lifting mechanism, the aligning mechanism is arranged above the cigarette filter rod holding mechanism, and the full box pushing mechanism is arranged below the cigarette filter rod pushing mechanism; on a second side of the motion axis of the lifting mechanism, the box pushing mechanism is arranged above the discharge conveyor belt; and the lifting mechanism is configured to receive the cigarette filter rod box body pushed by the box pushing mechanism and successively convey the cigarette filter rod box body from top to bottom to a filter rod pushing position of the cigarette filter rod pushing mechanism and a full box pushing position of the full box pushing mechanism; the discharge conveyor belt receives and conveys the cigarette filter rod box body filled with cigarette filter rods, the cigarette filter rod box body filled with the cigarette filter rods is pushed out by the full box pushing mechanism.

* * * * *